US005324604A

United States Patent [19]

Bugner et al.

[11] Patent Number: 5,324,604

[45] Date of Patent: Jun. 28, 1994

[54] MULTI-ACTIVE ELECTROPHOTOGRAPHIC ELEMENT AND IMAGING PROCESS USING FREE RADICALS AS CHARGE TRANSPORT MATERIAL

[75] Inventors: Douglas E. Bugner; Teh-Ming Kung; Ralph H. Young, all of Rochester, N.Y.

[73] Assignee: Eastman Kodak Company, Rochester, N.Y.

[21] Appl. No.: 716,197

[22] Filed: Jun. 17, 1991

[51] Int. Cl.[5] ..... G03G 5/047

[52] U.S. Cl. ..... 430/58; 430/57

[58] Field of Search ..... 430/54, 58, 70, 71, 430/72

[56] References Cited

U.S. PATENT DOCUMENTS

| | | | |
|---|---|---|---|
| 3,347,941 | 10/1967 | Ballester et al. | 260/649 |
| 3,434,833 | 3/1969 | Fox | 430/73 |
| 3,600,169 | 8/1971 | Lawton | 96/1.5 |
| 3,997,342 | 12/1976 | Bailey | 96/1.6 |
| 4,187,205 | 2/1980 | Hatano et al. | 260/30.4 |
| 4,301,226 | 11/1981 | Contois et al. | 430/72 |
| 4,540,651 | 9/1985 | Fujimaki et al. | 430/72 |

FOREIGN PATENT DOCUMENTS

| | | |
|---|---|---|
| 072387 | 1/1974 | Japan . |
| 114015 | 7/1977 | Japan . |

OTHER PUBLICATIONS

Eley et al., *Semiconductivity of Organic Substances*, 63 Trans. Faraday Society 902–910 (1967).

Bagatyreva and Buchachenko, *Photochemical Investigation of Perchlorotriphenylmethyl Radicals*, 15 Kinetika i Kataliz 1152–1157 (Sep.–Oct. 1974).

Ponomarchuk et al., *Triphenylmethane Derivatives In Reactions of One-Electron Transfer*, 42 Zhurnal Obschei Khimii, 2712–2715 (Dec. 1972).

Chemical Abs. 92:127972y.

Ballester, M. Pascual, I; Torres, J. Unique Single Electron Transfers Between Chemically Insert Triphenylmethyl Radicals & Triphenylmethyl Anions, J. Org. Chem. 1990, 55, 3035–3044.

*Primary Examiner*—Marion E. McCamish
*Assistant Examiner*—Rosemary Ashton
*Attorney, Agent, or Firm*—Robert Luke Walker

[57] ABSTRACT

The present invention relates to a multi-active electrophotographic element having a charge-transport layer containing stable free radical compounds as the charge-transport material. A process of forming images with this element is also disclosed.

21 Claims, No Drawings

MULTI-ACTIVE ELECTROPHOTOGRAPHIC ELEMENT AND IMAGING PROCESS USING FREE RADICALS AS CHARGE TRANSPORT MATERIAL

FIELD OF INVENTION

This invention relates to a multi-active electrophotographic element with a charge transport layer containing stable free radical compounds as charge transport materials and an imaging process utilizing this element.

BACKGROUND OF THE INVENTION

Electrophotographic imaging processes and techniques have been extensively described in patents and other literature (e.g., U.S. Pat. Nos. 2,221,776; 2,277,013; 2,297,691; 2,357,809; 2,551,582; 2,825,814; 2,833,648; 3,220,324; 3,220,831; 3,220,833 and many others). Generally, these processes employ a photoconductive insulating material which is prepared to respond to imagewise exposure with electromagnetic radiation to form a latent electrostatic charge image. A variety of subsequent operations, now well-known in the art, can then be employed to produce a permanent record of this image.

Various types of photoconductive insulating materials are known for use in electrophotographic imaging processes. In many conventional electrophotographic elements, the photoconductive insulating material is in a single layer composition affixed to a conductive support.

In addition, various multi-active layer electrophotographic elements, i.e., those having more than one active layer, have been described in the art. One useful type of multi-active electrophotographic element is described in U.S. Pat. No. 3,165,405 to Hoesterey at column 2, lines 6–20 thereof.

As described in Hoesterey, photoconductivity is achieved by applying a uniform positive charge to the surface of an element containing two layers of zinc oxide (i.e. a sensitized zinc oxide bottom layer and an unsensitized zinc oxide upper layer) and then exposing the sensitized bottom layer to a pattern of activating radiation. Photoconductivity is produced in the element by the electrical interaction of the two zinc oxide layers. Specifically, the sensitized zinc oxide bottom layer generates photoelectrons, i.e. negative charge carriers, and injects these charge carriers into the unsensitized zinc oxide upper layer which accepts and transports these charge carriers to the positively charged surface of the photoconductive element. The former layer is typically referred to as a charge generation layer, while the latter is a charge transport layer.

The concept of using two or more active layers in an electrophotographic element, with at least one layer designed primarily for the photogeneration of charge carriers and at least one other layer transporting such generated charge carriers, has been discussed in the patent literature. In addition to the above-noted Hoesterey patent, these patents include: U.S. Pat. No. 3,041,166 to Bardeen; U.S. Pat. No. 3,394,001 to Makino; U.S. Pat. No. 3,679,405 to Makino et al.; U.S. Pat. No. 3,725,058 to Hayaski et. al.; U.S. Pat. No. 4,175,960 to Berwick et al.; U.S. Pat. No. 4,618,560 to Borsenberger et al.; U.S. Pat. No. 4,719,163 to Staudenmayer et al.; Canadian Patent No. 930,591 issued Jul. 24, 1973; Canadian Patent Nos. 932,197-199 issued Aug. 21, 1973; and British Patent Nos. 1,337,228 and 1,343,671.

Various shortcomings still exist in multi-active electrophotographic elements. For example, the multi-active elements of the Hoesterey patent suffer from the disadvantages of low speed and difficulty in cleaning. Other multi-active elements, such as those described in Canadian Patent Nos. 930,591 and 932,199, are primarily designed for positive charging and, therefore, may not be suitable for electrophotographic processes where a negative charging mode is employed.

The charge-transport layer utilized in multi-active electrophotographic elements has employed a wide variety of charge-transport materials. Most charge-transport materials preferentially accept and transport either positive charges (i.e. holes) or negative charges (i.e. electrons). Transport materials which exhibit a preference for conduction of positive charge carriers are referred to as "p-type" transport materials, while those which preferentially conduct negative charges are referred to as "n-type". In a few cases, transport materials are capable of transporting either electrons or holes. These are referred to as "bipolar" transport materials.

N-type transport materials, used in conjunction with positively charged toners, are particularly suited to "neg-pos" imaging. Neg-pos imaging is also known as discharged area development ("DAD"), wherein the light-struck (discharged) regions of the element are developed with the positive toner. Neg-pos imaging is commonly performed by laser or light-emitting diode (LED) printers. Examples of n-type transport materials are disclosed in U.S. Pat. Nos. 4,277,551, 4,609,602, 4,719,163, 4,948,911, 4,175,960, 4,514,481, 4,474,865, 4,546,059, 4,869,984, 4,869,985, 4,909,966, 4,913,996, 4,514,481 and 4,921,637.

N-type transport materials generally suffer a number of drawbacks, including low mobility of the photoelectrons, low electrophotographic speeds, high dark conductivity, poor solubility in or compatibility with binder materials, and Poor mechanical properties such as brittleness of the coating.

P-type charge-transport materials, used in conjunction with positively charged toners, are commonly used for "pos-pos" imaging. Pos-Pos imaging is also known as charged area development ("CAD"), wherein the unexposed and charged areas of the element are developed with positive toner Pos-Pos imaging is commonly seen in conventional optical copiers. Representative p-type charge-transport materials include carbazole materials, arylamine-containing materials and polyarylalkane materials. These and other illustrative p-type charge-transport materials are disclosed in Staudenmayer et al., cited above. Although, p-type charge-transport materials are superior in many respects to n-type materials, a continued need for improvement remains.

The multi-active elements described, for example, in U.S. Pat. Nos. 4,719,163, 4,618,560, and 4,175,960 disclose embodiments using only a p-type or an n-type charge transport material. Therefore, electrophotographic apparatus employing such elements are restricted to either neg-pos imaging or pos-pos imaging and cannot perform both.

Bipolar charge-transport material offers the advantage of an electrophotographic element capable of performing either neg-pos or pos-pos imaging by simply changing the polarity of the applied charge. This allows one machine to act as both an optical copier and an electronic printer. However, bipolar charge-transport materials currently available suffer many of the same disadvantages as n-type charge-transport materials in that they typically comprise a mixture of n-type and p-type charge-transport material.

Free radicals (i.e. an atom or group of atoms possessing an unpaired electron) have been known to have photochemical and photoconductive properties as disclosed in Eley et al., *Semiconductivity of Organic Substances,* 63 Trans. Faraday Society 902–910 (1967) and Bogatyreva and Buchachenko, *Photochemical Investigation of Perchlorotriphenylmethyl Radicals,* 15 Kinetika i Kataliz 1152–1157 (Sep.–Oct. 1974). In electrophotographic systems, such compounds have been used to form electrostatic images by changing the conductance of light-sensitive reproduction sheets. This is disclosed in U.S. Pat. No. 3,600,169 to Lawton, Japanese Patent No. 114015 issued Jul. 15, 1977, and Japanese Patent No. 072387 issued Jan. 14, 1974. Stable free radicals have been used as sensitizers to increase the photosensitivity of photoresponsive compositions, as disclosed in U.S. Pat. No. 3,434,833 to Fox. However, free radical compounds have not been used as a charge-transport material in the charge transport layer of a multi-active electrophotographic element.

SUMMARY OF THE INVENTION

It has been found unexpectedly that free radical compounds represented by the following formula function as bipolar charge-transport materials:

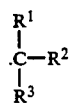

wherein:

°C. is a carbon atom with an unpaired electron and $R^1$, $R^2$, and $R^3$ are the same or different and each represent a hydrogen, alkyl, aryl, aralkyl, arylene, alkylene, heterocyclic arylene, imino, or halogen group; or a substituted alkyl, aryl, aralkyl, arylene, alkylene, heterocyclic arylene or imino group; or an alkyl, aryl, aralkyl, arylene, alkylene or heterocyclic arylene group which links two or more °C. atoms; or are themselves linked.

In accordance with this invention, a multi-active electrophotographic element is disclosed comprising a charge-generation layer, a charge-transport layer contiguous with the charge-generation layer, and a conductive support in electrical contact with either the charge-generation or charge-transport layer, wherein the charge-transport material of the charge-transport layer comprises a free radical compound of the above formula.

This electrophotographic element is unique from other, known elements in that it contains charge-transport materials possessing one or more free radical sites. This element has also been unexpectedly found to perform either neg-pos or pos-pos imaging by simply changing the Polarity of the charging device. Further the element has the additional advantage of offering, for both n-type and p-type transport, satisfactory electrophotographic properties, such as speed and dark decay.

The present invention also discloses an electrophotographic imaging process which utilizes the above-described electrophotographic element. This process comprises the steps of: applying a uniform electrostatic charge to the free surface of the electrophotographic element, exposing the element to activating radiation after thus charging the element, developing the charged and exposed element by applying charged toner particles to the element to produce a toned image, and optionally transferring the toned image to a suitable receiver.

DETAILED DESCRIPTION OF THE INVENTION

As noted above, the present invention relates to a multi-active electrophotographic element comprising a charge-generation layer, a charge-transport layer that comprises a stable free radical compound, and a conductive support in electrical contact with either the charge-generation or charge-transport layer.

The charge-transport layer used in the present invention, as its name implies, is a composition which, in the presence of an electrical field, accepts the charge carriers injected into it by the charge-generation layer and transports, i.e. conducts, the charge carriers to the opposite surface of the charge-transport layer. The electrical force driving charge carriers through the transport layer is supplied by a potential difference applied across the multi-active element. Such an electrical driving force may be established, for example, in conventional electrophotographic imaging processes by maintaining the conductive substrate of the element at a given reference potential and applying a uniform electrostatic charge to the free surface of the multi-active element in the absence of activating radiation.

The term "activating radiation" as used in the present specification is defined as electromagnetic radiation capable of generating electron-hole pairs in the charge-generation layer upon exposure. Thus, when the charge-generation layer is exposed to activating radiation, charge carriers, i.e. electron-hole pairs, are photogenerated in the layer. In the absence of activating radiation, the uniform electrostatic charge applied to the surface of the multi-active element is held at or near the surface due to the electrical insulating properties of the charge generation and charge transport layers.

Either the charge-generation layer or the charge-transport layer may be used as the surface layer of the electrophotographic element of the invention with the other being in contact with the conductive substrate. These layers are in electrical contact with one another so that charge carriers generated in the charge-generation layer can flow into the charge-transport layer. The electrical resistivities of the charge-transport layer and the charge-generation layer, in the absence of activating radiation or any other radiation to which the charge-transport layer may be sensitive, should be at least about $1\times10^{13}$ ohm-cm at 25° C. In general, it is advantageous to use a combination of a charge transport and charge-generation layer having a resistivity one or more orders of magnitude higher than $1\times10^{13}$ ohm-cm, i.e., layers having an electrical resistivity greater than about $1\times10^{14}$ ohm-cm at 25° C.

The charge-generation layer of the present invention may be formed from any number of known materials capable, upon exposure to activating radiation, of generating and injecting charge carriers into the charge-transport layer. Illustrative charge-generation materials include phthalocyanine pigments, squarylium pigments, and trigonal selenium. A particularly preferred class of charge-generation material is titanylphthalocyanines.

The charge-generation layer may also include other constituents such as binders, adhesives, and levelling aids.

The components of the charge-generation layer of the present invention may be present in the following percentages, as shown in Table I.

TABLE I

| Component | Concentration Suitable | Preferred |
|---|---|---|
| Charge-generation material | 1–100 | 30–70 (wt % of dried solids) |
| Binder | 0–99 | 30–70 (wt % of dried solids) |
| Adhesive | 0–10 | 1–5 (wt % of dried solids) |
| Levelling aid | 0–0.10 | 0.005–0.05 (wt % of coating solution) |

The essential component of the charge transport layer of the present invention is a carbon free-radical compound of the general formula:

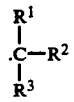

wherein

•C. is a carbon atom with an unpaired electron and $R^1$, $R^2$, and $R^3$ are the same or different and each represent a hydrogen, alkyl, aryl, aralkyl, arylene, alkylene, heterocyclic arylene, imino or halogen group; or a substituted alkyl, aryl, aralkyl, arylene, alkylene, heterocyclic arylene or imino group; or an alkyl, aryl, aralkyl, arylene, alkylene or heterocyclic arylene group linking two or more •C. atoms; or are themselves linked.

Many free radical compounds are unstable and react spontaneously with oxygen, solvents, or other compounds or polymers they contact, rendering such compounds unsuitable as charge-transport materials. However, many of the carbon free radical compounds depicted by the general formula above are stable in electrophotographic environments and are, therefore, suitable as the charge-transport materials.

Suitable stable carbon free-radical compounds are disclosed in U.S. Pat. No. 3,600,169 to Lawton, which is incorporated herein by reference. These compounds include: α,γ-bisdiphenylene-β-phenylallyl, α,γ-bisdiphenylene-β-(p-isopropylphenyl)allyl, α,γ-bisdiphenylene-β-(p-isopropenylphenyl)allyl, perchlorodiphenylmethyl, triphenylmethyl, diphenylbiphenylmethyl. phenylbis(biphenyl)methyl, alkyl and alkoxy substituted triphenylmethyls, 4,4'polymethylenebis(triphenylmethyl)s, pentaphenylcyclopentadienyl, perchlorophenylmethyl, (o-ethoxyphenyl)diphenylmethyl, 9-phenylfluorenyl, diphenyl-β-naphthylmethyl, α-methoxydiphenylmethyl, dimesitylmethyl, p,p'-triphenylenebis(diphenylmethyl), α-naphthylbis(biphenyl)methyl, pentaphenylethyl, bis(2,5-di-tert-butylphenyl)methyl, dibenzofulvenylmethyl, 4-(perchlorophenyl)diphenylmethyl, 4,4'-bis(perchlorophenyl)diphenylmethyl, perchlorotriphenylmethyl, 4-(perchlorophenyl)triphenylmethyl, 4,4'-bis(perchlorophenyl)triphenylmethyl, 4,4',4''-tris(perchlorophenyl)triphenylmethyl, 4,4'-bis(diphenylmethyl)biphenyl, and tris(4-E-tetrachlorophenyl)methyl wherein E represents an electron-withdrawing group such as halo, nitro, alkoxycarbonyl, trihalomethyl, cyano, keto, or sulfonyl.

Especially preferred compounds include: α,γ-bisdiphenylene-β-phenylallyl, 1,1'-biphenyl-4,4'-bis(diphenylmethyl), and tris(4-E-tetrachlorophenyl)methyl, wherein E represents an electron-withdrawing group such as halo, nitro, alkoxycarbonyl, trihalomethyl, cyano, keto, and the like.

The charge-transport layer may consist entirely of the free radical charge-transport materials described above. Preferably, however, the charge-transport layer will contain a mixture of the charge-transport material and a suitable film-forming polymeric binder material. Such binder materials provide the charge-transport layer with electrical insulating characteristics. The binder also serves as a film-forming material useful in (a) applying the charge-transport layer as a coating, (b) adhering the charge-transport layer to an adjacent substrate, and (c) providing a smooth, easy to clean, and wear resistant surface.

In some instances the charge-transport material may be conveniently applied without a separate binder. For example, where the charge-transport material is itself a polymeric material, such as poly(styryldiphenylmethyl), there is no need to use a separate polymeric binder. However, even in this case, the use of an additional polymeric binder may enhance desirable physical properties such as adhesion, resistance to cracking, etc.

Where a polymeric binder material is employed in the charge-transport layer, the optimum ratio of charge-transport material to binder material may vary widely depending on the particular polymeric binder(s) and particular charge-transport material(s) employed. In general, it has been found that, when a binder material is employed, useful results are obtained where the amount of active charge-transport material contained within the charge-transport layer varies from about 5 to about 90 weight percent based on the dry weight of the charge-transport layer.

Suitable binders for use in the charge-transport layer are film-forming polymeric materials having a fairly high dielectric strength and good electrically insulating properties. These include styrene-butadiene copolymers; polyvinyl toluene-styrene copolymers; styrene-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrenes; isobutylene polymers; polyesters, such as poly[ethylene-co-alkylenebis(alkyleneoxyaryl)phenylenedicarboxylate]s; phenolformaldehyde resins; ketone resins; polyamides, polycarbonates, polythiocarbonates; poly[ethylene-co-isopropylidene-2,2'-bis(ethyleneoxyphene)-terephthalate]; copolymers of vinyl haloarylates and vinyl acetate such as poly(vinyl-m-bromobenzoate-co-vinyl acetate); chlorinated poly(olefins), such as chlorinated poly(ethylene); etc. Methods of making resins of this type have been described in the prior art, for example, styrene-alkyd resins can be prepared according to the method described in U.S. Pat. No. 2,361,019 to Gerhart and U.S. Pat. No. 2,258,423 to Rust. Other types of binders which can be used in charge transport layers include paraffin, mineral waxes, etc., as well as combinations of binder materials.

In general, it has been found that polymers containing aromatic groups are most effective as charge-transport layer binders. Aromatic-containing polymers which are especially useful for bipolar charge transport include styrene-containing polymers, bisphenol-A polycarbonate polymers, polyesters such as poly[4,4'-(2-norbornylidene)bisphenyleneazelate-co-terephthalate], and copolymers of vinyl benzoates and vinyl acetate such as poly(vinyl-m-bromobenzoate-co-vinyl acetate).

The charge-transport layer may also contain other addenda such as leveling agents, surfactants, plasticizers, and the like to enhance various physical properties of the layer. In addition, various addenda to modify the electrophotographic response of the element may be incorporated in the charge-transport layer.

The charge-generation and charge-transport layers are typically coated on an electrically conductive support, i.e., a support material which is electrically conductive itself or a support material comprised of a non-conductive substrate coated with a conductive layer. The support can be fabricated in any suitable configuration, such as in the form of a sheet, a drum, or an endless belt. Exemplary electrically conductive support materials include: paper (at a relative humidity above 20 percent); aluminum-paper laminates; metal foils such as aluminum foil, zinc foil, etc.; metal plates or drums, such as aluminum, copper, zinc, brass, and galvanized plates or drums; vapor deposited metal layers such as silver, chromium, nickel, aluminum and the like coated on paper or conventional photographic film bases such as cellulose acetate, poly(ethylene terephthalate), polystyrene, etc. Conducting materials such as chromium, nickel, etc., can be vacuum deposited on transparent film supports in sufficiently thin layers so that the resulting electrophotographic elements can be exposed from either side of the element. An especially useful conducting support can be prepared by coating a support material such as poly(ethylene terephthalate) with a conducting layer containing a semi-conductor dispersed in a resin. Such conducting layers, both with and without electrical barrier layers, are described in U.S. Pat. No. 3,245,833 to Trevoy.

Other useful conducting layers include compositions consisting essentially of an intimate mixture of at least one inorganic oxide and from about 30 to about 70 percent by weight of at least one conducting metal (e.g., a vacuum-deposited cermet conducting layer as described in U.S. Pat. No. 3,880,657 to Rasch). Likewise, a suitable conductive coating can be prepared from the sodium salt of a carboxyester lactone of maleic anhydride and a vinyl acetate polymer. Such conducting layers and methods for their preparation and use are disclosed in U.S. Pat. Nos. 3,007,901 to Minsk and 3,262,807 to Sterman et al.

In addition to the essential charge-generation and charge-transport layers, the multi-active electrophotographic element of this invention can contain various optional layers, such as overcoat layers, barrier layers, and the like.

In certain instances, it is advantageous to utilize one or more adhesive interlayers between the conducting substrate and the active layers in order to improve adhesion to the conducting substrate and/or to act as an electrical barrier layer as described in U.S. Pat. No. 2,940,348 to Dessauer. Such interlayers, if used, typically have a dry thickness in the range of about 0.1 to about 5 microns. Typical materials which may be used include film-forming polymers such as cellulose nitrate, polyesters, copolymers of vinyl pyrrolidone and vinyl acetate, and various vinylidene chloride-containing polymers including two, three and four component polymers prepared from polymerizable blends of monomers or prepolymers containing at least 60 Percent by weight of vinylidene chloride. A partial list of representative vinylidene chloride-methyl methacrylate-itaconic acid terpolymers is disclosed in U.S Pat. No. 3,143,421. Various vinylidene chloride containing hydrosol tetrapolymers which may be used include tetrapolymers of vinylidene chloride, methyl acrylate, acrylonitrile, and acrylic acid as disclosed in U.S. Pat. No. 3,640,708. A partial listing of other useful vinylidene chloride-containing copolymers includes poly(vinylidene chloride-co-methyl acrylate), poly(vinylidene chloride-co-methacrylonitrile), poly(vinylidene chloride-co-acrylonitrile), and poly(vinylidene chloride-co-acrylonitrile-co-methyl acrylate). Other useful materials include the so-called "tergels" which are described in U.S. Pat. No. 3,501,301 to Nadeau et al.

One especially useful interlayer material which may be employed in the multi-active element of the invention is a hydrophobic film-forming polymer or copolymer free from any acid-containing group, such as a carboxyl group, prepared from a blend of monomers or prepolymers, each of said monomers or prepolymers containing one or more polymerizable ethylenically unsaturated groups. A partial listing of such useful materials includes many of the above-mentioned copolymers, and, in addition, poly(vinylidene chloride-co-methyl methacrylate), and the like.

Optional overcoat layers may be used in the present invention, if desired. For example, to improve surface hardness and resistance to abrasion, the surface layer of the multi-active element of the invention may be coated with one or more electrically insulating, organic polymer coatings or electrically insulating, inorganic coatings. A number of such coatings are well known in the art, and, accordingly, extended discussion is unnecessary. Typical useful overcoats are described, for example, in *Research Disclosure*, "ElectroPhotographic Elements, Materials, and Processes", Volume 109, page 63, Paragraph V, May, 1973, which is incorporated by reference herein.

Optionally, low surface adhesion materials may be added either as a separate overcoat or as addenda to the top layer of the element. These materials are utilized to improve transfer of the toner images to receiver materials. Low surface adhesion materials are disclosed in, for example, U.S. Pat. Nos. 4,772,526 and 4,847,175.

The electrophotographic element of the present invention is employed in the electrophotographic process detailed below. The process involves the steps of electrostatically charging the surface of the element, imagewise exposing the surface to form a latent electrostatic image, and developing the image with charged toner particles. The toner image is then optionally transferred to a suitable receiver material, where it may be permanently fixed.

The surface layer of the present electrophotographic element is charged by the use of a device such as a corona charger. In the element of the present invention, either the charge-generation or charge-transport layer may serve as the surface layer.

Preferably, the charge-transport layer serves as the surface layer. In such an embodiment, the stronger charge-transport layer will protect the relatively fragile charge-generation layer. The process of the present invention will be described relative to an embodiment featuring the charge-transport layer as the surface layer.

After charging, the element is exposed to activating radiation. The activating radiation generates charge carriers, i.e. electron-hole pairs, in the charge generation layer. If the surface of the element is subject to a uniform negative charge, the holes will be transported to the free surface and the electrons will migrate to the conductive support which is maintained at a positive reference potential relative to the uniform negative electrostatic charge of the surface. Once migration is complete, the original negative uniform charge applied to the surface layer of the element is neutralized at the points of exposure to activating radiation.

If the surface layer of the element is subject to a uniform positive charge, the electrons will be transported to the free surface of the element and the holes will migrate to the conductive support which is maintained at a negative reference potential relative to the uniform positive electrostatic charge of the surface. Again, after migration is complete, the original positive charge applied to the surface layer of the element is neutralized at the points of exposure to activating radiation.

As a result of the charge neutralization on the surface layer, a latent electrostatic image is formed on the element. This image may be developed by charged toner particles, and the toned image may be transferred either directly to a suitable receiver (e.g., paper or transparent polyester film), or to an intermediate drum or web and subsequently transferred to paper or film. The toner particles may then be fused to the receiver and any residual, untransferred toner cleaned away from the electrophotographic element and/or intermediate drum or web.

The toner particles are in the form of a dust, a powder, a pigment in a resinous carrier, or a liquid developer in which the toner particles are carried in an electrically insulating liquid carrier. Methods of such development are widely known and described as, for example, in U.S. Pat. Nos. 2,296,691, 3,893,935, 4,076,857, and 4,546,060.

Development can be achieved either with a charged toner having the same polarity as the latent electrostatic image (DAD) or with a charged toner having the opposite polarity from the latent electrostatic image (CAD).

In the element of the present invention, the surface of the element may be charged either positively or negatively, and the resulting electrostatic latent image can be developed with a toner of a given polarity to yield either a DAD or CAD image, as desired.

The invention is further illustrated by the following examples.

EXAMPLES

In the examples which follow, the preparation of representative materials, the formulation of representative film packages, and the characterization of these films are described. These examples are provided to illustrate the usefulness of the electrophotographic element of the present invention and are by no means intended to exclude the use of other elements which fall within the above disclosure.

The element of the following examples are prepared as follows, In Examples 1 and 2, aluminized poly(ethylene terephthalate) is used as the conductive support. It is prepared by vacuum-depositing a thin conductive layer of aluminum onto a 178 μm film of poly(ethylene terephthalate). Next, the charge-generation layer (CGL) is prepared by dispersing titanyltetrafluorophthalocyanine (described more extensively in U.S. Pat. No. 4,701,396) in a solution of a polymeric binder comprising poly[4,4'-(2-norbornylidene)bisphenyleneazelate-co-terephthalate (60/40)]in dichloromethane (DCM), with a weight ratio of charge-generation material to binder of 2:1. The dispersion is ball milled for 60 hours, then diluted with a mixture of DCM and 1,1,2-trichloroethane (TCE) (to yield a final DCM:TCE weight ratio of 80:20) to achieve suitable coating viscosity. The dispersion is then coated onto the conductive layer of the conductive support, and the solvent is dried off to yield a CGL with a thickness of 0.5 μm.

In Examples 3–6, aluminum is replaced with a thin conductive layer of nickel which is vacuum deposited onto the poly(ethylene terephthalate) support. Thereupon was coated an approximately 0.02 μm thick adhesive interlayer of poly[ethylene glycol-co-neopentylglycol (55/45) terephthalate]. The CGL is formed by evaporation-deposition of selenium charge-generation material onto the adhesive interlayer to form a CGL with a thickness of about 0.4 μm.

In all six examples, the charge-transport layer (CTL) was prepared as follows: A coating solution comprising 10 weight percent solids dissolved in DCM is prepared. The solids comprise the inventive charge-transport material and the polymeric binder as described specifically in each example. In Examples 1 and 2, a siloxane surfactant (DC-510, supplied by Dow Chemical) is added in the amount of approximately 0.01 weight percent. The resulting solution (with or without surfactant) is coated onto the CGL and dried to form the CTL on the CGL. The combined thickness of the CGL and CTL is in the range of 7 to 10 μm.

Conventional photoconductivity measurements are performed on samples of the films described below. The films are charged to the stated levels and polarities with a corona discharge device. Dark decay rate is calculated by holding the charged film samples in the dark for several seconds and measuring the decrease in surface potential over that time. Low intensity light (ca. 5 erg/cm$^2$-sec), which is passed through a monochromator set at a desired wavelength, is used to discharge the film.

EXAMPLE 1

A photoconductive film comprising a charge transport layer (CTL) of 13 wt % α,γ-bisdiphenylene-β-phenylallyl and 87 wt % poly[4,4'-(2-norbornylidene)bisphenyleneazelate-co-terephthalate (60/40)] as polymeric binder, a charge-generation layer (CGL) of titanyltetrafluorophthalocyanine, and a conductive support of aluminized polyethyleneterephthalate film, was charged to +494 V. The film displayed a dark decay of 3 V/sec. When exposed through the CTL to monochromatic light at 830 nm wavelength with an irradiance of 3 ergs/cm$^2$-sec, it photodischarged at a rate of 11.9 V/sec for the first 50 V.

EXAMPLE 2

A photoconductor was prepared as described above in Example 1, except that 22 wt % α,γ-bisdiphenylene-β-phenylallyl and 78 wt % poly[4,4'-(2-norbornylidene)bisphenyleneazelate-co-terephthalate (60/40)] as binder were used in the CTL. It displayed a dark decay of 4 V/sec, and photodischarged at a rate of 23.4 V/sec for the first 50 V when exposed in the same manner as Example 1.

EXAMPLE 3

A photoconductor comprising a CTL of 22 wt % α,γ-bisdiphenylene-β-phenylallyl and 78 wt % polystyrene as binder, a CGL of selenium, and a conductive support of nickelized polyethyleneterephthalate, was charged to +425 V. It had a dark decay rate of 4 V/sec. When exposed through the CTL to monochromatic light of wavelength 550 nm and irradiance 24 ergs/cm$^2$-sec, it required 216 ergs/cm$^2$ exposure for a discharge to 225 V and could be discharged to ca. 130 V by further exposure.

EXAMPLE 4

The same sample as in Example 3, charged to −455 V, had a dark decay of 1 V/sec. When exposed as in Example 3, it required 550 ergs/cm$^2$ for discharge to −250 V.

EXAMPLE 5

A photoconductor like that in Example 3, except that the CTL contained 37 wt % α,γ-bisdiphenylene-β-phenylallyl and 63 wt % polystyrene as binder, was charged to +494 V. It had a dark decay rate of 0.6 V/sec. When exposed through the nickel layer to monochromatic light of 400 nm wavelength and 5.5 ergs/cm$^2$-sec irradiance, it required 41 ergs/cm$^2$ for discharge to +297 V and could be discharged to ca. +220 V by further exposure.

EXAMPLE 6

The same sample as in Example 5, charged to −487 V, had a dark decay rate of 2 V/sec and required 64 ergs/cm$^2$ for discharge to −243 V.

Examples 3–6 clearly demonstrate the bipolar characteristics of the inventive elements. The inventive elements are effectively charged either positively or negatively and in each case demonstrate favorable electrophotographic properties (i.e., good photodischarge and low rate of dark decay).

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A multi-active electrophotographic element comprising:
   a charge-generation layer;
   a charge-transport layer contiguous with said charge-generation layer, wherein said charge-transport layer comprises:
   a stable free radical compound defined by the formula:

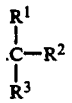

wherein:
°C. is a carbon atom with an unpaired electron and
$R^1$, $R^2$, and $R^3$ are the same or different and each represent a hydrogen, alkyl, aryl, aralkyl, arylene, alkylene, heterocyclic arylene, imino or halogen group; or a substituted alkyl, aryl, aralkyl, arylene, alkylene, heterocyclic arylene or imino group; or an alkyl, aryl, aralkyl, arylene, alkylene or heterocyclic arylene group linking two or more °C. atoms; or are themselves linked; and
   a conductive support in electrical contact with either said charge-generation layer or said charge-transport layer.

2. The element of claim 1, wherein said stable free radical compound is chosen from the group consisting of α,γ-bisdiphenylene-β-phenylallyl, α,γ-bisdiphenylene-β-(p-isopropylphenyl)allyl, α,γ-bisdiphenylene-β-(p-isopropenylphenyl)allyl, perchlorodiphenylmethyl, triphenylmethyl, diphenylbiphenylmethyl, phenylbis(-biphenyl)methyl, alkyl and alkoxy substituted triphenylmethyls, 4,4'-polymethylenebis(triphenylmethyl)s, pentaphenylcyclopentadienyl, perchlorophenylmethyl, (o-ethoxyphenyl)diphenylmethyl, 9-phenylfluorenyl, diphenyl-β-naphthylmethyl, α-methoxydiphenylmethyl, dimesitylmethYl, p,p'-triphenylenebis(diphenylmethyl), α-naphthylbis(biphenyl)methyl, pentaphenylethyl, bis(2,5-di-tert-butylphenyl)methyl, dibenzofulvenylmethyl, 4-(perchlorophenyl)diphenylmethyl, 4,4'-bis(perchlorophenyl)diphenylmethyl, perchlorotriphenylmethyl, 4-(perchlorophenyl)triphenylmethyl, 4,4'-bis(perchlorophenyl)triphenylmethyl, 4,4',4''-tris(-perchlorophenyl)triphenylmethyl, 4,4'-bis(diphenylmethyl)biphenyl, and tris(4-E-tetrachlorophenyl)methyl wherein E represents an electron-withdrawing group such as halo, nitro, alkoxycarbonyl, trihalomethyl, cyano, keto, or sulfonyl.

3. The element of claim 2, wherein said stable free radical compound is chosen from the group consisting of α,γ-bisdiphenylene-β-phenylallyl, 4,4'-bis(diphenylmethyl)biphenyl, and tris (4-E-tetrachlorophenyl)-methyl wherein E represents an electron-withdrawing group such as halo, nitro, alkoxycarbonyl, trihalomethyl, cyano, keto, or sulfonyl.

4. The element of claim 1, wherein said charge-generation layer is contiguous to both said charge-transport layer and said conductive support.

5. The element of claim 1, wherein said charge-transport layer is contiguous to both said charge-generation layer and said conductive support.

6. The element of claim 1 further comprising:
   a polymeric binder.

7. The element of claim 6, wherein said binder is selected from the group consisting of polycarbonates, polyesters, polyolefins, styrenic polymers, phenolic resins, paraffins, and mineral waxes.

8. The element of claim 7, wherein said binder is chosen from the group consisting of bisphenol-A polycarbonate polymers, copolymers of vinyl benzoates and vinyl acetate, and 5 poly[4,4'-(2-norbornylidene)bisphenyleneazelate-co-terephthalate)].

9. The element of claim 1 further comprising:
   an adhesive interlayer.

10. The element of claim 1, wherein said element is suitable for either neg-pos imaging or pos-pos imaging.

11. A multi-active electrophotographic element comprising:
   a charge-generation layer;
   a charge-transport layer contiguous with said charge-generation layer, wherein said charge-transport layer comprises:
   a polymeric binder;
   a stable free radical compound chosen from the group consisting of
   α,γ-bisdiphenylene-β-phenylallyl,
   α,γ-bis(diphenylmethyl) biphenyl, and tris(4-E-tetrachlorophenyl)methyl wherein E represents an electron-withdrawing group such as halo, nitro, alkoxycarbonyl, trihalomethyl, cyano, keto, or sulfonyl; and a conductive support in electrical contact with said charge-generation layer.

12. An electrophotographic process using a multiactive electrophotographic element comprising:

a charge-generation layer;

a charge-transport layer contiguous with said charge-generation layer, wherein said charge-transport layer comprises:

a stable free radical compound defined by the formula:

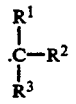

wherein:

°C. is a carbon atom with an unpaired electron and $R^1$, $R^2$, and $R^3$ are the same or different and each represent a hydrogen, alkyl, aryl, aralkyl, arylene, alkylene, heterocyclic arylene, imino or halogen group; or a substituted alkyl, aryl, aralkyl, arylene, alkylene, heterocyclic arylene or imino group; or an alkyl, aryl, aralkyl, arylene, alkylene or heterocyclic arylene group linking two or more °C. atoms; or are themselves linked; and a conductive support in electrical contact with either said charge-generation layer or said charge-transport layer, said process comprising:

charging said element;

exposing said charged element to activating radiation; and developing the charged and exposed element by applying charged toner particles to said element to produce a toned image.

13. A process according to claim 12, wherein the stable free radical compound is chosen from the group consisting of α,γ-bisdiphenylene-β-phenylallyl, α,γ-bisdiphenylene-β-(p-isopropylphenyl)allyl, α,γ-bisdiphenylene-β-(p-isopropenyIphenyI)allyl, perchlorodiphenylmethyl, triphenylmethyl, diphenylbiphenylmethyl, phenylbis(biphenyl)methyl, alkyl and alkoxy substituted triphenylmethyls, 4,4'-polymethylenebis(triphenylmethyl)s, pentaphenylcyclopentadienyl, perchlorophenylmethyl, (o-ethoxyphenyl)diphenylmethyl, 9-phenylfluorenyl, diphenyl-β-naphthylmethyl, α-methoxydiphenylmethyl, dimesitylmethyl, p,p'-triphenylenebis(diphenylmethyl), α-naphthylbis(biphenyl)methyl, pentaphenylethYl, bis(2,5-di-tert-butylphenyl)methyl, dibenzofulvenylmethyl, 4-(perchlorophenyl)diphenylmethyl, 4,4'-bis(perchlorophenyl)diphenylmethyl, perchlorotriphenylmethyl, 4-(perchlorophenyl)triphenylmethyl, 4,4'-bis(perchlorophenyl)triphenylmethyl, 4,4',4''-tris(perchlorophenyl)triphenylmethyl, 4,4'-bis(diphenylmethyl)biphenyl, and tris(4-E-tetrachlorophenyl)methyl wherein E represents an electron-withdrawing group such as halo, nitro, alkoxycarbonyl, trihalomethyl, cyano, keto, or sulfonyl.

14. A process according to claim 13, wherein the stable free radical compound is chosen from the group consisting of α,γ-bisdiphenylene-β-phenylallyl, 4,4'-bis(diphenylmethyl)biphenyl, and tris (4-E-tetrachlorophenyl)methyl, wherein E represents an electron-withdrawing group such as halo, nitro, alkoxycarbonyl, trihalomethyl, cyano, keto, or sulfonyl.

15. A process according to claim 12, wherein said element and said toner particles are charged to perform pos-pos imaging.

16. A process according to claim 12, wherein said element and said toner particles are charged to perform neg-pos imaging.

17. A process according to claim 12 further comprising:

transferring the toned image to a suitable receiver.

18. A process according to claim 17 further comprising:

bonding said toned image to said receiver.

19. A process according to claim 17 further comprising:

cleaning any residual toner particles not transferred to the receiver from said element for each print made.

20. A process according to claim 17, wherein the receiver is a substrate suitable for Permanently receiving a toned image as a print.

21. A process according to claim 17 wherein said receiver is suitable for overhead projection.

* * * * *

UNITED STATES PATENT AND TRADEMARK OFFICE

CERTIFICATE OF CORRECTION

PATENT NO. : 5,324,604

DATED : June 28, 1994

INVENTOR(S) : Douglas E. Bugner, et al.

It is certified that error appears in the above-indentified patent and that said Letters Patent is hereby corrected as shown below:

Column 11, Line 62
Delete "$R^{2,}$" and insert --$R^2$,-- therefor.

Column 12, Line 17
Delete "dimesitylmethYl," and insert --dimesitylmethyl,-- therefor.

Column 12, Line 51
After 'and', delete "5".

Column 13, Line 23
Delete "$R^{2,}$" and insert --$R^2$,-- therefor.

Column 13, Lines 45 and 46
Delete "α,γ-bisdiphenylene-β-(p-isopropenyIphenyI)allyl," and insert --α,γ-bisdiphenylene-β-(p-isopropenylphenyl)allyl,-- therefor.

Column 14, Line 8
Delete "pentaphenylethYl," and insert --pentaphenylethyl,-- therefor.

UNITED STATES PATENT AND TRADEMARK OFFICE

CERTIFICATE OF CORRECTION

PATENT NO. : 5,324,604

DATED : June 26, 1994

INVENTOR(S) : Douglas E. Bugner, et al.

It is certified that error appears in the above-indentified patent and that said Letters Patent is hereby corrected as shown below:

Column 14, Line 43

Delete "Permanently" and insert --permanently-- therefor.

Signed and Sealed this

First Day of November, 1994

Bruce Lehman

*Attest:*

BRUCE LEHMAN

*Attesting Officer*

*Commissioner of Patents and Trademarks*